US007563114B2

(12) United States Patent
Patterson

(10) Patent No.: US 7,563,114 B2
(45) Date of Patent: Jul. 21, 2009

(54) LEVER MATED CONNECTOR ASSEMBLY WITH A LOW PROFILE POSITION ASSURANCE MEMBER

(75) Inventor: Jeremy Patterson, Greensboro, NC (US)

(73) Assignee: TYCO Electronics Corporation, Middletown, PA (US)

( * ) Notice: Subject to any disclaimer, the term of this patent is extended or adjusted under 35 U.S.C. 154(b) by 0 days.

(21) Appl. No.: 11/708,966

(22) Filed: Feb. 21, 2007

(65) Prior Publication Data

US 2007/0197071 A1 Aug. 23, 2007

Related U.S. Application Data

(60) Provisional application No. 60/775,827, filed on Feb. 21, 2006.

(51) Int. Cl.
*H01R 13/62* (2006.01)

(52) U.S. Cl. ..... 439/157

(58) Field of Classification Search ..... 439/157, 439/152, 155, 160, 372
See application file for complete search history.

(56) References Cited

U.S. PATENT DOCUMENTS

| | | | | |
|---|---|---|---|---|
| 4,370,013 | A * | 1/1983 | Niitsu et al. | 439/352 |
| 5,401,179 | A | 3/1995 | Shinchi et al. | |
| 5,873,745 | A * | 2/1999 | Duclos et al. | 439/157 |
| 6,071,153 | A | 6/2000 | Fink et al. | |
| 6,217,354 | B1 | 4/2001 | Fencl et al. | |
| 6,319,050 | B1 * | 11/2001 | Miyazaki et al. | 439/489 |
| 6,325,647 | B1 * | 12/2001 | May et al. | 439/157 |
| 6,328,582 | B1 * | 12/2001 | Fukamachi | 439/157 |
| 6,361,356 | B1 | 3/2002 | Heberlein et al. | |
| 6,547,584 | B2 | 4/2003 | Myer et al. | |
| 6,558,176 | B1 | 5/2003 | Martin et al. | |
| 6,595,809 | B2 * | 7/2003 | Matsumoto et al. | 439/835 |
| 6,773,279 | B2 * | 8/2004 | Yamashita | 439/157 |
| 6,824,406 | B1 * | 11/2004 | Sharples et al. | 439/157 |
| 7,175,451 | B2 * | 2/2007 | Shuey | 439/157 |
| 2003/0109155 | A1 | 6/2003 | Yamashita | |
| 2004/0192090 | A1 | 9/2004 | Flowers et al. | |
| 2005/0026484 | A1 * | 2/2005 | Demuth | 439/157 |
| 2006/0040535 | A1 * | 2/2006 | Koshy et al. | 439/157 |
| 2006/0040536 | A1 * | 2/2006 | Putnam et al. | 439/157 |

FOREIGN PATENT DOCUMENTS

| | | |
|---|---|---|
| EP | 0 674 362 | 9/1995 |
| EP | 0 926 772 | 6/1999 |
| WO | WO 2006/101816 | 9/2006 |

* cited by examiner

*Primary Examiner*—T C Patel
*Assistant Examiner*—Vladimir Imas

(57) ABSTRACT

A lever mated connector assembly including a housing configured to mate with a header, a wire guide mounted to the housing having a latch with a retaining surface, and a lever having a catch with a retaining surface and being coupled to the housing for rotational movement between an unlocked position and a locked position wherein the catch retaining surface engages the latch retaining surface to inhibit movement of the lever out of the locked position. A connector position assurance (CPA) member has a locking surface mounted to the wire guide in a low profile configuration for movement between a first position and a second position. The CPA is attached to the wire guide by way of a dovetail interlocking arrangement.

20 Claims, 7 Drawing Sheets

LEVER MATED CONNECTOR ASSEMBLY WITH A LOW PROFILE POSITION ASSURANCE MEMBER

This application claims priority from provisional application No. 60/775,827 filed Feb. 21, 2006, the entirety of which is incorporated herein by reference.

FIELD OF THE INVENTION

The present invention generally relates to connectors, and more particularly to a lever mated connector assembly having a low profile connector position assurance ("CPA") member for preventing movement of the connector assembly lever out of a locked position.

BACKGROUND OF THE INVENTION

In certain applications, electrical connectors must be securely mated to one another to prevent disconnection of the electrical signals routed through the connector conductors. For example, in automotive applications wherein electrical signals are routed to safety equipment such as air bag deployment systems or other systems relating to the operational or safety features of the vehicle, disconnection of the electrical signals as a result of accident, negligence, or operating conditions such as vibration, etc. may result in undesirable consequences. Thus, some electrical connectors are coupled to connector assemblies that mechanically lock the electrical connectors in mating engagement with one another.

Some conventional connector assemblies include a housing that houses an electrical connector, a wire guide attached to the housing which helps to organize cable of the electrical connector, and a lever that couples the housing to a header housing. When in a locked position, the lever prevents disconnection of the housing from the header, which prevents disconnection of the mated electrical connectors. Some levers are further configured to latch into engagement with the wire guide when the lever is in the locked position to ensure that the lever is not unintentionally moved out of the locked position. If sufficient force is applied to such levers, however, they may disengage from the wire guide and permit disconnection of the mated electrical connectors. It is also desirable to provide a connector position assurance member (CPA) to prevent disengagement of the lever from the wire guide, and to provide the CPA with as low of a profile as possible, in order to reduce the swing radius of the levers. This helps in the packaging of the connector assemblies within confined spaces.

SUMMARY OF THE INVENTION

In one embodiment, a connector assembly comprises a connector housing first portion, having an upper surface, and a locking mechanism, profiled to lie proximate to the upper surface. An interengaging locking mechanism is provided between the connector housing first portion and the locking mechanism, where the interengaging locking mechanism is positioned below the upper surface of the locking mechanism.

In another embodiment, a connector assembly comprises a wire guide having a latch with a retaining surface. A lever is also provided having a catch with a retaining surface, the lever being movable between an unlocked position and a locked position wherein the catch retaining surface engages the latch retaining surface to inhibit movement of the lever out of the locked position. A CPA has a locking surface, the CPA being moveable between a first position and a second position wherein the locking surface inhibits movement of the latch, thereby further inhibiting movement of the lever out of the locked position. An interengaging locking mechanism is provided between a lower surface of the CPA and an upper surface of the wire guide which allows slidable movement of the CPA.

The above mentioned and other features of this invention, and the manner of attaining them, will become more apparent and the invention itself will be better understood by reference to the following description of embodiments of the invention taken in conjunction with the accompanying drawings.

Figure 1:
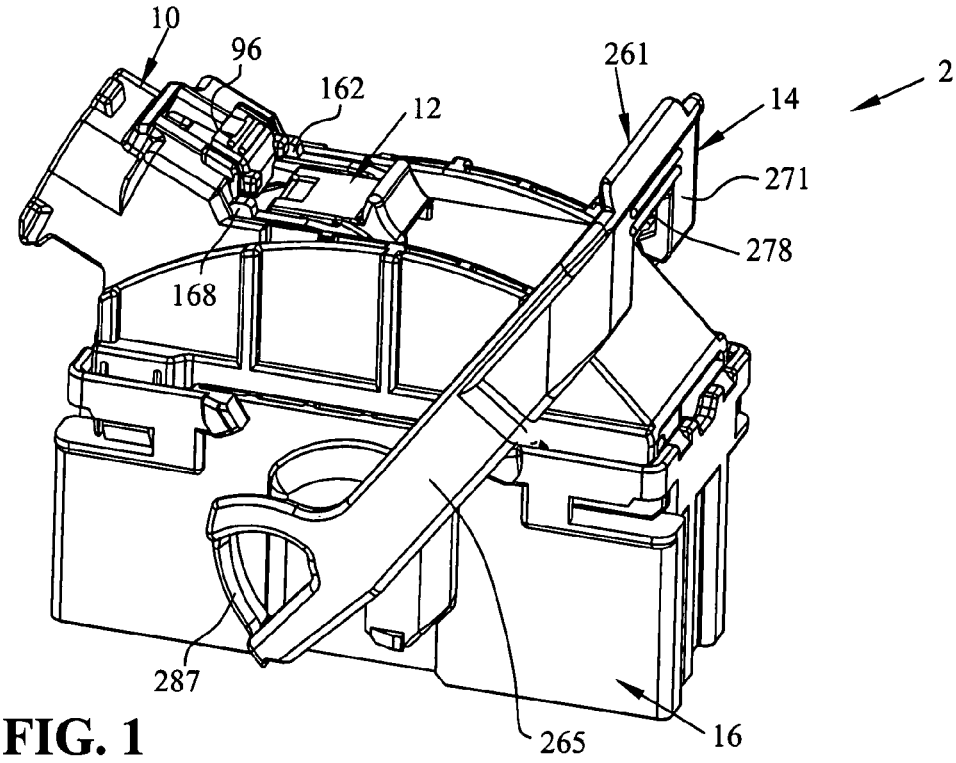
FIG. 1 is a perspective view of one embodiment of a lever mated connector assembly according to the present invention depicting the lever in an unlocked position.

Corresponding reference characters indicate corresponding parts throughout the several views. Although the drawings represent embodiments of the present invention, the drawings are not necessarily to scale and certain features may be exaggerated in order to better illustrate and explain the present invention.

DETAILED DESCRIPTION OF EMBODIMENTS OF THE INVENTION

The embodiments disclosed below are not intended to be exhaustive or to limit the invention to the precise forms disclosed in the following detailed description. Rather, the embodiments are chosen and described so that others skilled in the art may utilize their teachings.

Referring first to FIG. 1, an embodiment of the invention will be described. As shown first in FIG. 1, a lever mated connector assembly is shown at 2 comprised of a wire guide 10, a connector position assurance member (CPA) 12, a rotatable lever 14 and a housing 16. It should be appreciated that, lever 14 is rotatable between the position of FIG. 1, to the position of FIG. 3 where it would be locked in place. That is, CPA 12 acts as a locking mechanism to retain rotatable lever in place in the locked position. It should also be appreciated that housing 16 would mate with a pin header as is known in the art. Alternatively, the connector could also mate to another connector with male contacts to create a wire-to-wire application. This application also incorporates by reference, the disclosure of U.S. Pat. No. 7,175,451 issued Feb. 13, 2007.

Figure 4:
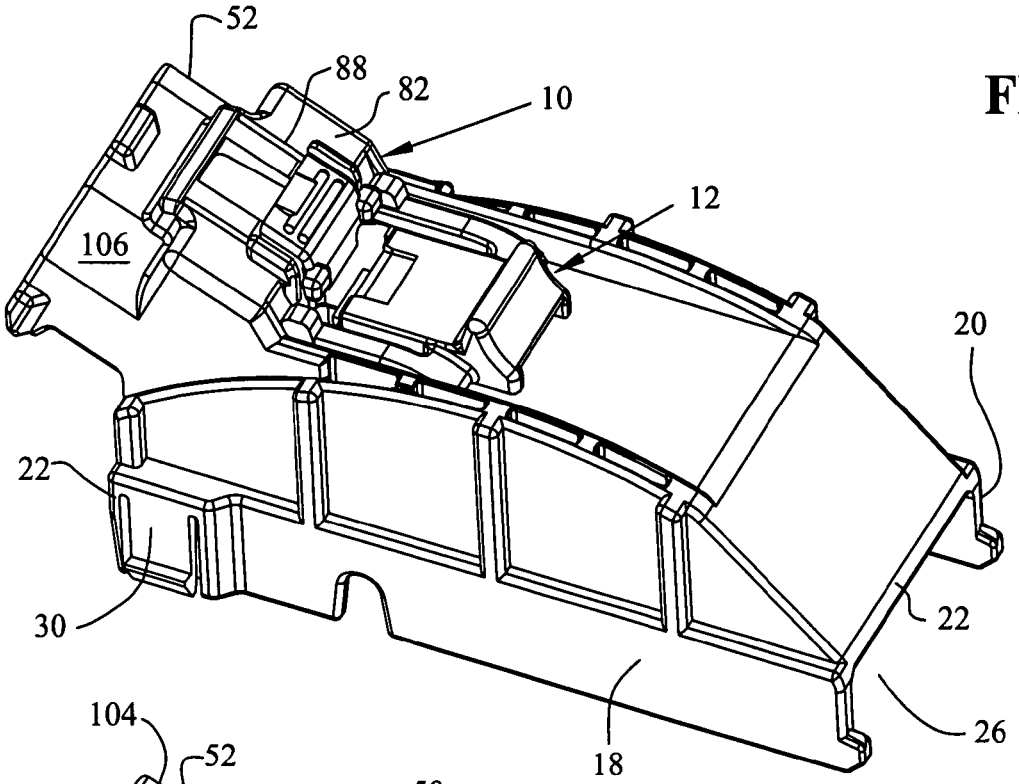
FIG. 4 is a perspective view of the wire guide showing the CPA attached to the wire guide in an unlocked position.
Figure 5:
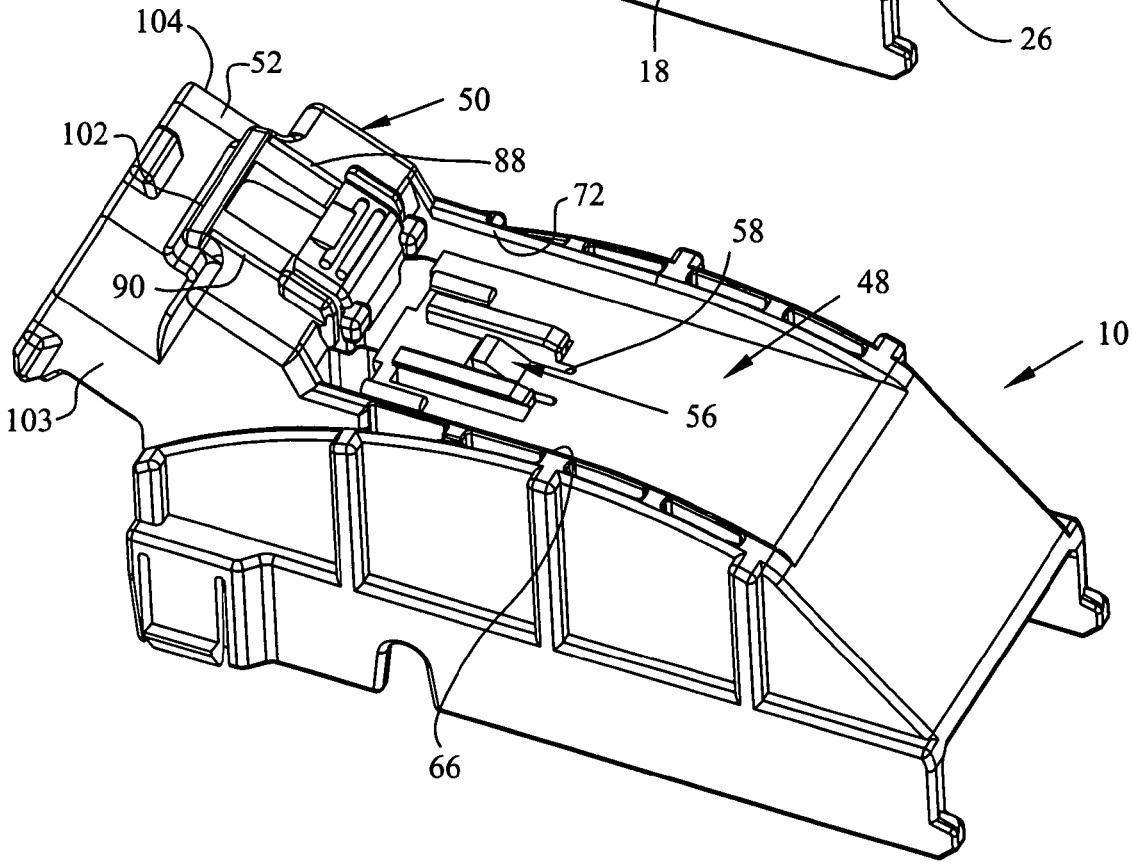
FIG. 5 is a perspective view similar to that of FIG. 4 with the CPA removed.

As shown in FIGS. 4 and 5, wire guide 10 includes sidewalls 18 and 20 and end walls 22, defining an interior space 26. Wire guide 10 includes tabs 30 and 42 (FIG. 8) which retain wire guide 10 to housing 16. As shown in FIG. 5, wire guide 10 defines a CPA receiving portion 48, a lever retaining portion 50 and a wire shroud 52.

Figure 6:
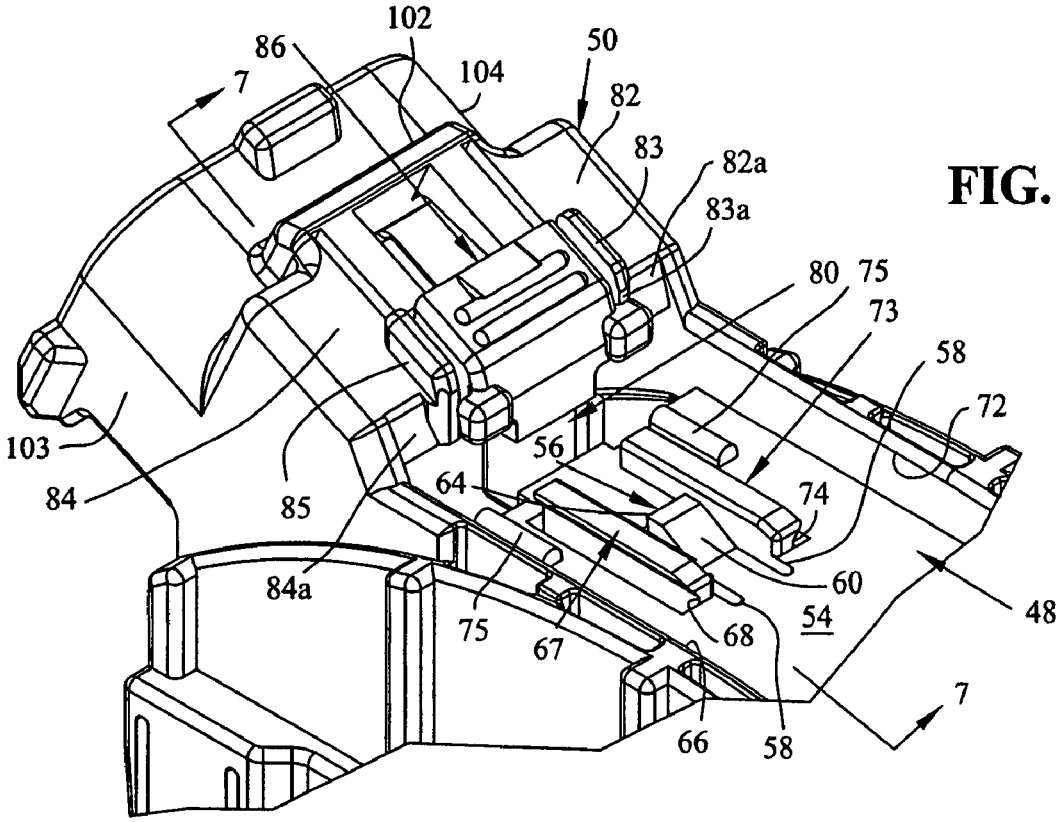
FIG. 6 is an enlarged view of the latch portion of the wire guide of FIGS. 4 and 5.
Figure 12:
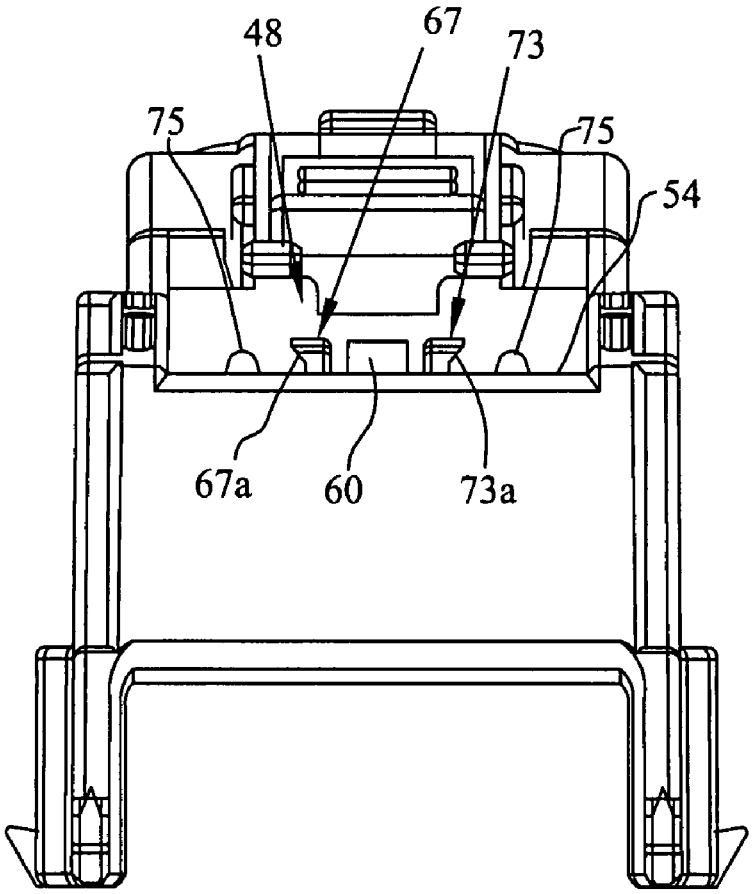
FIG. 12 is a front plan view of the wire guide with the CPA removed.

As best shown in FIG. 6, CPA receiving portion 48 includes a top flat wall 54 with a retaining wedge or latch 56, defined by cutouts 58 molded in the plastic wire guide 10, and surrounding the latch 56. As shown in FIG. 6, retaining wedge 56 includes a camming surface 60 together with a retaining surface 64. CPA receiving portion 48 further includes inner edges 66 and 72, where edges 66, 72 flank dovetail flanges 67, 73. As shown best in FIGS. 6 and 7 dovetail flanges 67 and 73 include outwardly extending ridges 68 and 74, respectively, which define dovetail surfaces 67*a*, 73*a* as best shown in FIG. 12. As also shown in FIG. 6, ribs 75 flank dovetail flanges 67, 73 and define stop edges 77, as best shown in FIG. 7.

Figure 7:
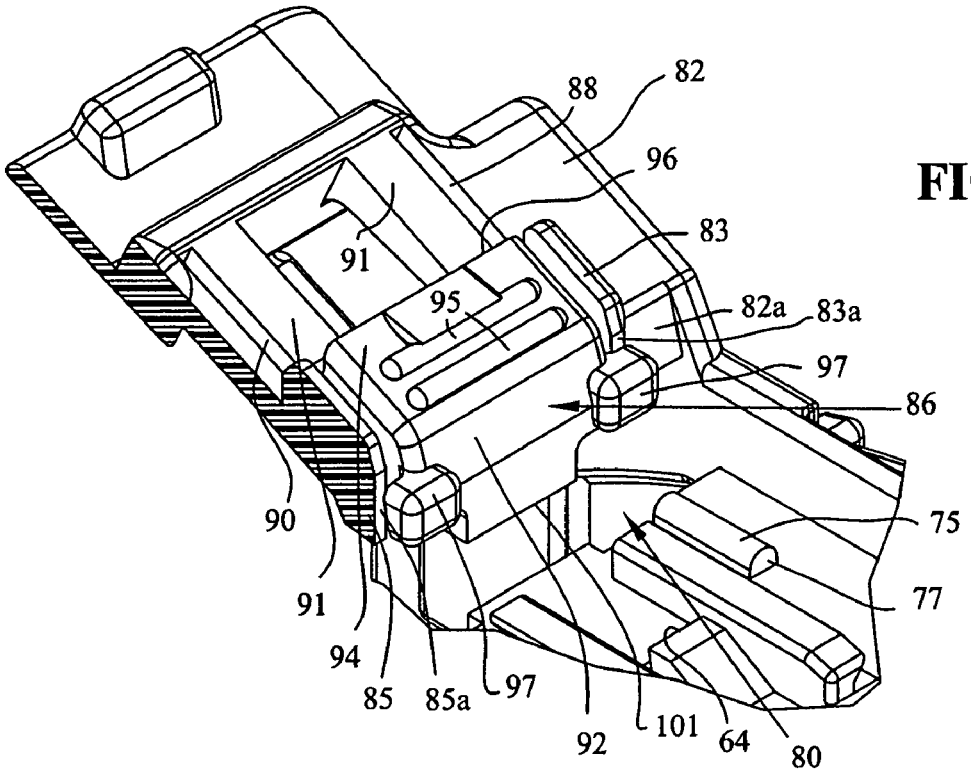
FIG. 7 is a cross sectional view through lines 7-7 of FIG. 6.

With respect still to FIGS. 6 and 7, lever retaining portion 50 intersects with CPA receiving portion 48 to define an opening 80, through which a portion of CPA 12 will be received, as further described herein. Lever retaining portion 50 further includes flats 82 and 84 which define abutting surfaces 82*a*, 84*a*, respectively as best shown in FIG. 6. As best shown in FIGS. 6 and 7, flat 82 has an upstanding wall 83 defining a forwardly directed engaging surface 83*a*, and flat 84 has an upstanding wall 85 defining a forwardly directed engaging surface 85*a* (FIG. 7).

Again with respect to FIGS. 6 and 7, walls 83 and 85 flank cantilever latch 86 which is defined by cutouts 88 and 90 (FIG. 7) through flats 82, 84. Cantilever latch 86 extends from wire guide 10 by way of cantilever arms 91 as shown in FIG. 7. The front edge of cantilever latch 86 includes a cam surface 92 which continues upwardly to define an upper surface 94 having tactile ribs 95.

Cantilever latch 86 includes a retaining surface at 96 for locking with lever 14 as will be described herein. Cantilever latch 86 further includes two overstress wings 97 which extend to a width greater than front edges 83*a*, 85*a*, to define an overstress stop for cantilever latch 86 as will also be further described herein.

Figure 8:
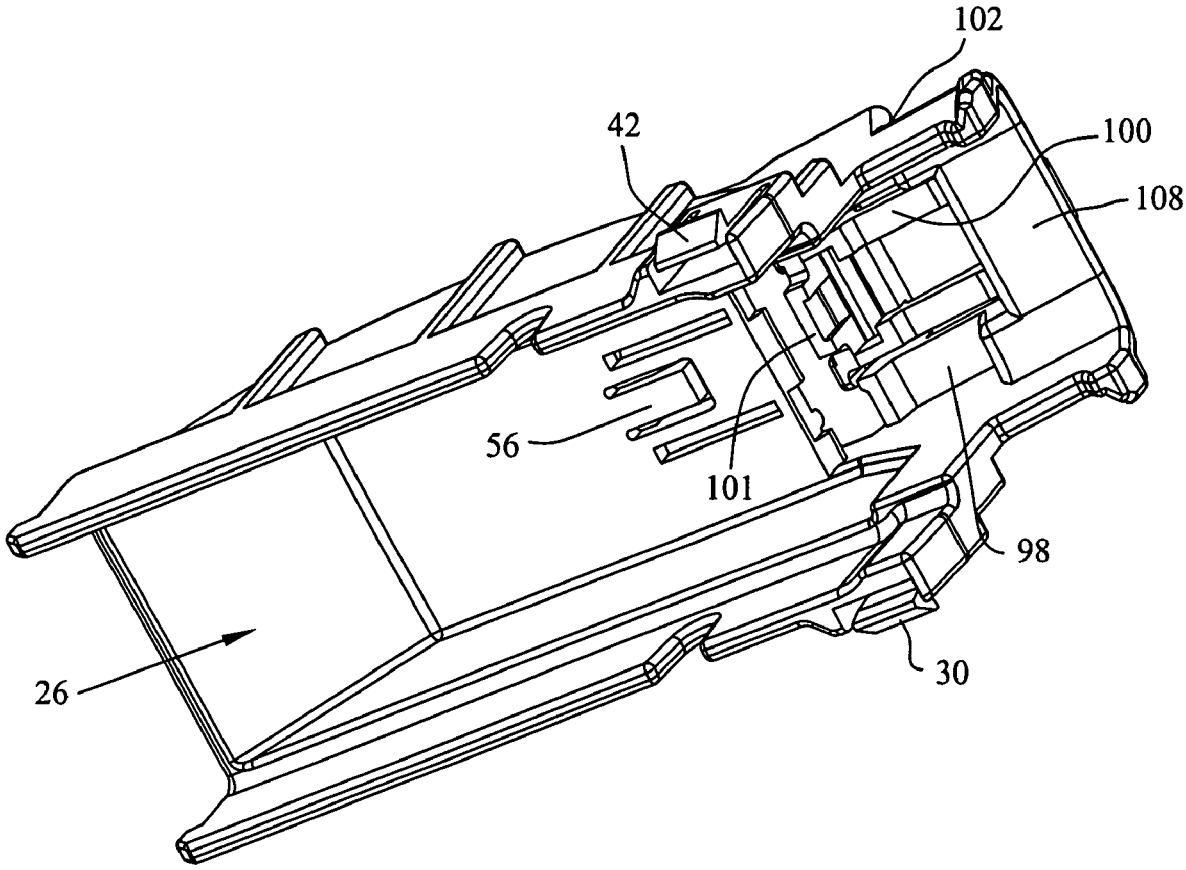
FIG. 8 is a underside perspective view of the wire guide.

With respect now to FIG. 8, recesses 98, 100 are shown which will receive a portion of CPA 12, as further described herein. Finally as shown in FIGS. 4 and 5, wire shroud 52 is defined by distal edge 102, shroud sidewalls 103, 104 together with upper wall 106 (FIG. 4), to define shroud opening 108 (FIG. 8). As shown in both FIGS. 7 and 8, cantilever latch 86 includes a lower edge 101, which will be used as a locking surface as described herein.

Figure 9:
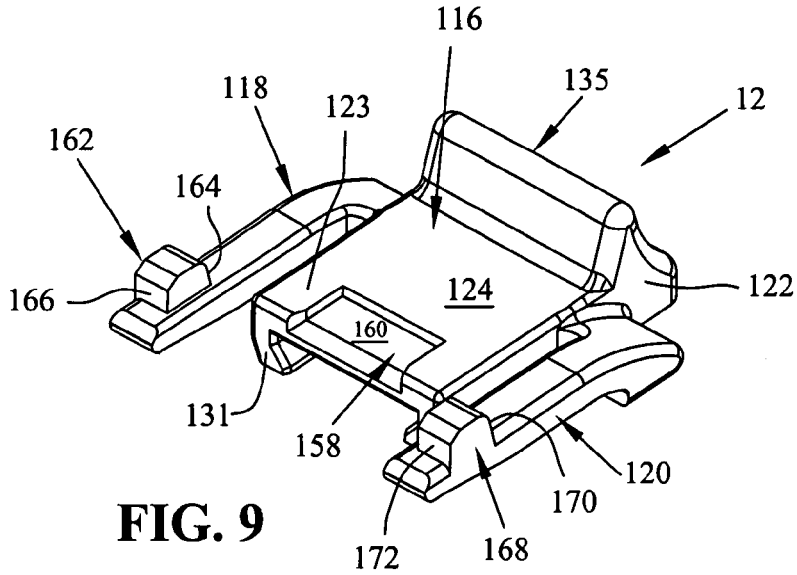
FIG. 9 is a front, top-side perspective view of the CPA shown in FIG. 6.
Figure 10:
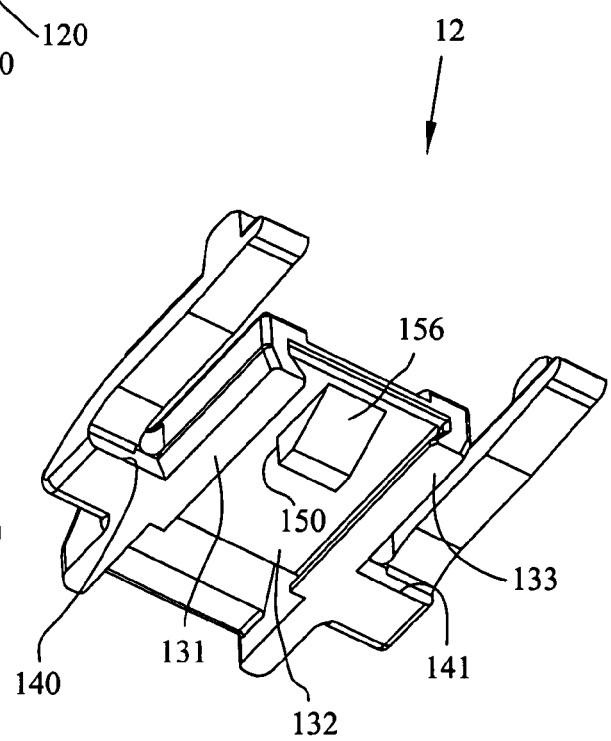
FIG. 10 is a front, underside perspective view of the CPA of FIG. 9.
Figure 11:
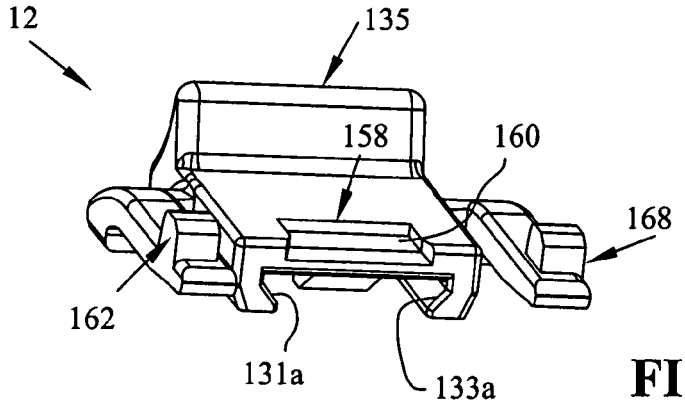
FIG. 11 is a front perspective view of the CPA shown in FIG. 9.

With reference now to FIG. 9-11, CPA 12 will be described in greater detail. CPA 12 includes a body 116 having arms 118, 120 flanking body 116. Body 116 includes base portion 122, an extension 123 having an upper wall 124. Rails 131 and 133 extend downwardly from lower wall 132 of body 116. Rails 131 and 133 define dove tail slots having dove tail surfaces 131*a*, 133*a* as best shown in FIG. 11. It should be appreciated that these cooperate with dove tail surfaces 67*a*, 73*a* described above.

CPA 12 further includes a push ridge 135 for longitudinal movement of CPA 12. With respect to FIG. 10, CPA 12 includes stop edges 140, 141, as well as a retaining wall 150 which cooperates with cam surface 156 in order to lock CPA to wire guide 10 as described herein. With respect to FIG. 9, arm 118 includes a retaining wedge 162, having cam surface 164 and forward surface 166. In a like manner retaining wedge 168 is positioned at a distal end of arm 120, having a cam surface 170 and a forward surface 172.

Figure 2:
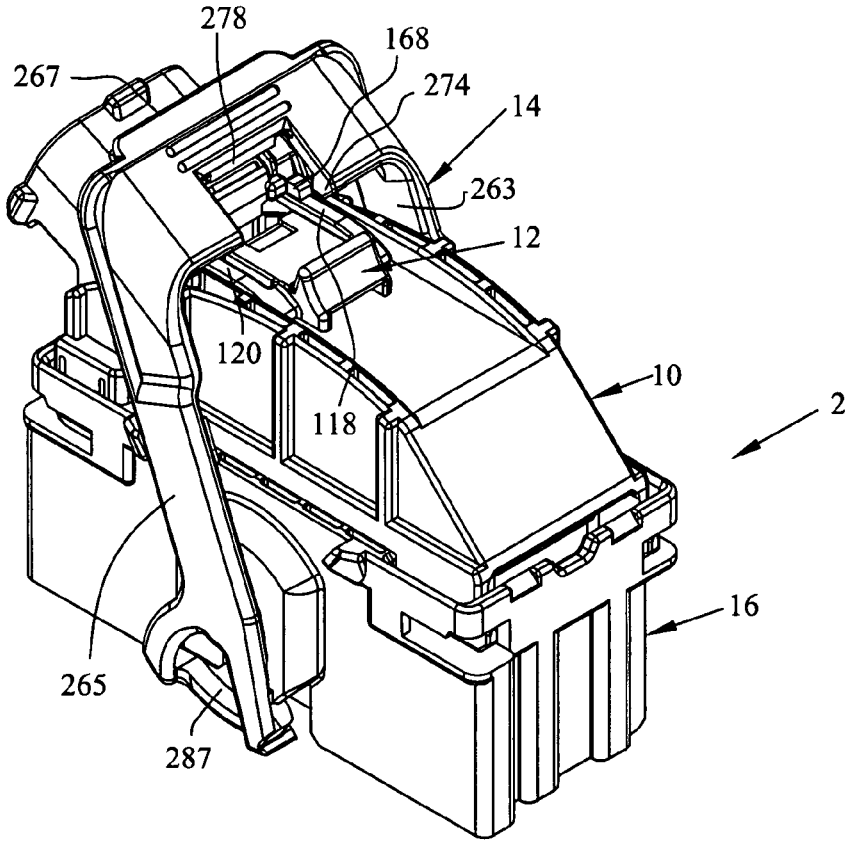
FIG. 2 is a view similar to that of FIG. 1 showing the lever in a position just prior to the fully locked position, with the CPA retracted.

With reference again to FIGS. 1 and 2, lever 14 includes handle 261 having support arms 263 and 265, where handle 261 has forward edge 267 and upper surface 271. Cams 274 (FIG. 2) flank arms 118, 120 and are profiled to contact retaining wedges 162, 168, as best shown in FIG. 1, upon rotation. Lever handle 261 further includes catch 278 profiled for engagement against retaining surface 96 of cantilever latch 86 as will also be described herein.

Figure 13:
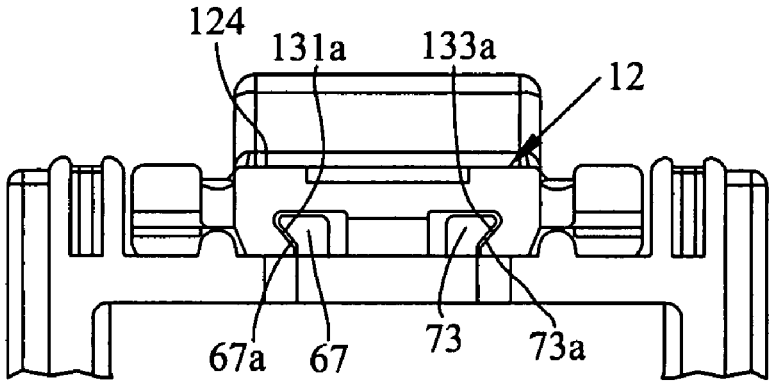
FIG. 13 is view similar to that of FIG. 12 with the CPA in place.

With the items as described above, the assembly and operation of assembly 2 will now be discussed in further detail. With respect first to FIGS. 4, and 11-12, CPA 12 is shown positioned in the CPA receiving portion 48 and retaining wedge 56 would be positioned adjacent to retaining wall 150. As shown in FIG. 12 and 13, due to the dovetail surfaces 67*a*, 131*a*, 73*a*, 133*a*, the CPA 12 is held fixedly mounted to the wire guide 10. The dovetail configuration also provides a low profile mounting arrangement. The CPA 12 is movable between the extreme positions where interaction of retaining surface 64 and retaining wall 150 define the fully retracted position, and where interaction of stop edges 77 and stop edges 140, 141 define the fully forward position.

Figure 3:
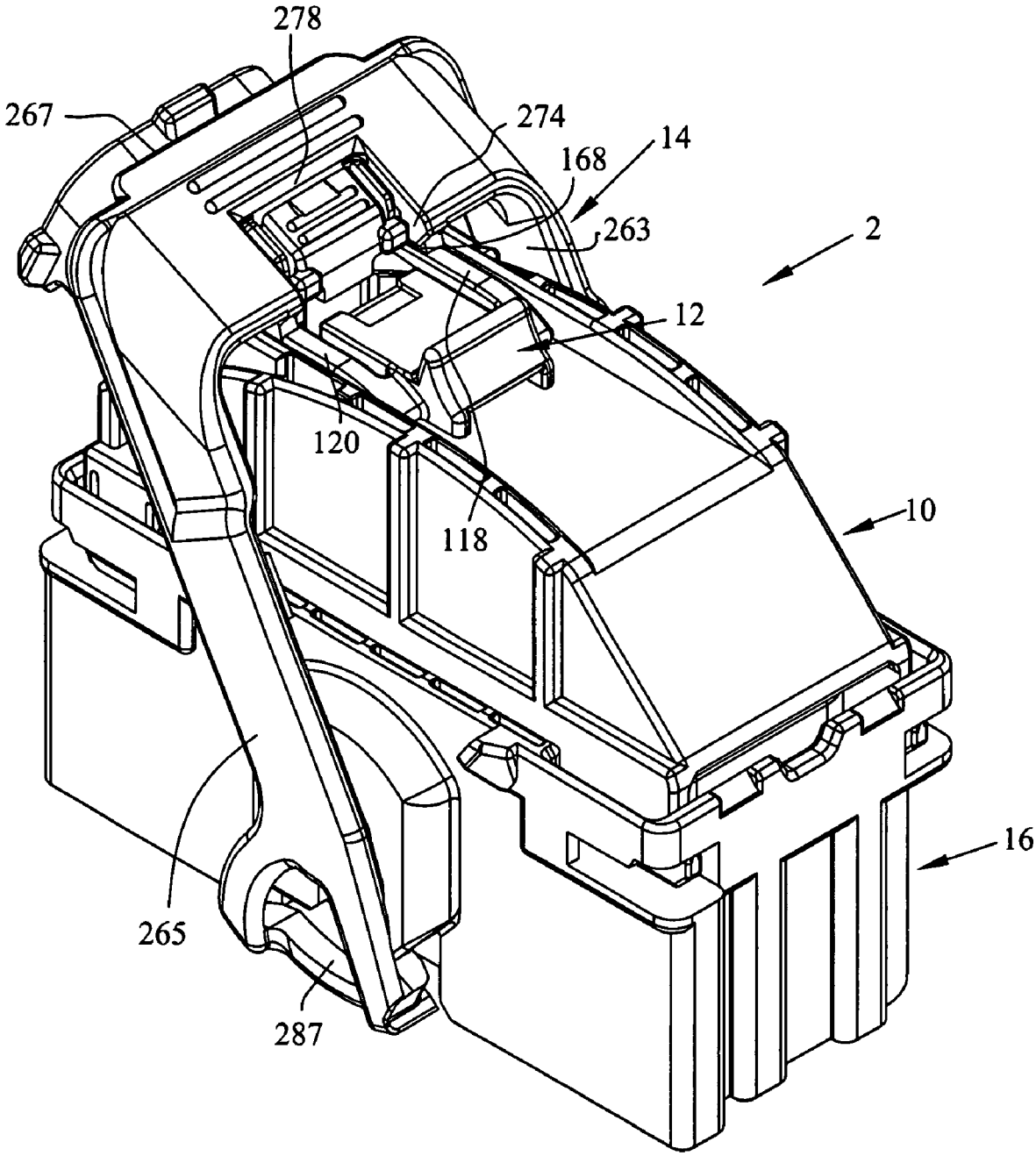
FIG. 3 is a view similar to that of FIG. 1 showing the lever in a position just prior to the fully locked position, with the CPA retracted.

When the connector is in the position of FIG. 1, CPA 12 cannot move forwardly, as forward surfaces 166 and 172 (FIG. 9) abut corresponding surfaces 82*a*, 84*a* (FIG. 6). However when the lever 14 is rotated to the position of FIG. 2, cam surfaces 274 of lever 14 (FIG. 2) interact with cam surfaces 164, 170 (FIG. 8) to deflect arms 118, 120 downwardly. However, the lever 14 must be mated and latched to retaining surface 96, as shown in FIG. 3, before the CPA 12 can be slid forward to the fully locked position. CPA 12 is slid forwardly such that recess 158 (FIG. 9) is received under lower edge 101 (FIG. 7) of cantilever latch 86. When in this position, retaining wedges 162 and 168 are received in corresponding recesses 98, 100, holding the CPA 12 in the latched position.

To disengage the lever, CPA 12 is moved back to the position of FIG. 3 and the upper surface 94 and tactile ribs 95 are depressed disengaging retaining surface 96 from catch 278. It should be appreciated that overstress wings 97 prevent breaking cantilever latch 86, or overstressing cantilever arms 91 as the overstress wings 97 will engage respective services 83*a*, 85*a* preventing any overstress. This interengagement is also further described in concurrently filed, commonly owned, application Ser. No. 11/708,863 which claims priority from provisional application No. 60/775,828, the disclosures of which are incorporated herein by reference.

As described, CPA 12 and wire guide 10 are provided with an interengaging locking mechanism by way of dovetail flanges 67, 73 and dovetail slots defined by surfaces 13 la and 133*a*. This interengagement is provided between lower wall 132 of CPA 12, and flat wall 54 of the wire guide 10. As shown in FIG. 13, all of this interengagement is provided below upper wall of 124 of the CPA 12. This places the CPA 12 is close proximity to the wire guide 10, which reduces the "overhead room" required and allows the lever to have a shallow swing radius. This provides for a reduced volume environment for the installation and operation of the entire assembly.

It should also be appreciated that the assembly provides for an ergonomic design, for example a user may place an index finger beneath forward edge 267 of lever 14, while at the same time placing a thumb on top of upper surface 94 and tactile ribs 95, whereby cantilever latch 86 may be depressed by the thumb for release.

What is claimed is:

1. A connector assembly, comprising:

a connector housing first portion, having a top wall;

a locking mechanism, profiled to lie proximate to the top wall and having an upper and lower surface;

an interengaging locking mechanism, allowing movement of the locking mechanism parallel to the top wall and locking the locking mechanism to the top wall in a direction normal to the top wall and provided between the connector housing first portion and the locking mechanism, the interengaging locking mechanism having a first locking portion positioned on the top wall of the connector housing, and a second portion extending from the lower surface of the locking mechanism, the first and second portions extending only between the top wall of the connector housing and the lower surface of the locking mechanism.

2. The connector assembly of claim 1, wherein the connector housing first portion is defined as a wire guide.

3. The connector assembly of claim 2, further comprising a connector housing second portion, for retaining a plurality of electrical terminals.

4. The connector assembly of claim 3, wherein the wire guide is attached to a rear face of the connector housing second portion, and is profiled to guide wires therethrough.

5. The connector assembly of claim 4, wherein a lever is attached to sidewalls of the connector housing second portion, and rotates over the locking mechanism.

6. The connector assembly of claim 5, wherein the wire guide includes a latch which latches the lever to the wire guide.

7. The connector assembly of claim 6, wherein the locking mechanism is profiled as a connector position assurance member and is slidably receivable under the latch, to prevent disconnection of the lever.

8. The connector assembly of claim 7, wherein the interengaging locking mechanism is provided as a dovetail slot and dovetail flange configuration.

9. The connector assembly of claim 1, wherein the interengaging locking mechanism is provided as a dovetail slot and dovetail flange configuration.

10. The connector assembly of claim 9, wherein the upper surface is provided with dovetail flanges therealong, which interengage with complementary dovetail surfaces on a lower surface of the locking mechanism.

11. The connector of claim 10, wherein a latching assembly is provided between the upper surface and the locking mechanism.

12. The connector of claim 11, wherein the latching assembly is provided between the dovetail slot and dovetail flange configuration.

13. The connector assembly of claim 1, further comprising a stop mechanism provided between the connector housing first portion and the locking mechanism, the stop mechanism being provided by complementary stop surfaces to define extreme positions of the locking mechanism.

14. A connector assembly, comprising:

a wire guide having a latch with a retaining surface;

a lever having a catch with a retaining surface, the lever being movable between an unlocked position and a locked position wherein the catch retaining surface engages the latch retaining surface to inhibit movement of the lever out of the locked position;

a connector position assurance member having a locking surface, the connector position assurance member being moveable between a first position and a second position wherein the locking surface inhibits movement of the latch, thereby further inhibiting movement of the lever out of the locked position; and an interengaging locking mechanism locking the connector position assurance member to the wire guide and provided between a first locking element which extends downwardly from a lower surface of the connector position assurance member and a second locking element which extends upwardly from an upper surface of the wire guide to allow slidable movement of the connector position assurance member, the interengagement between the first and second locking elements, extending only between the top wall of the connector housing and the lower surface of the connector position assurance member.

15. The connector assembly of claim 10, wherein the second locking element on the wire guide includes dovetail flanges for guiding movement of the connector position assurance member between the first position and the second position.

16. The connector assembly of claim 11, wherein the first locking element on the connector position assurance member includes dovetail slots that move within the pair of dovetail flanges as the connector position assurance member moves between the first position and the second position.

17. The connector assembly of claim 10, wherein the wire guide includes a retaining wedge having a retaining surface that engages a retaining surface formed on the connector position assurance member to prevent the connector position assurance member from moving in a first direction out of the first position.

18. The connector assembly of claim 14, wherein the connector position assurance member includes a push ridge for use in moving the connector position assurance member between the first position and the second position.

19. The connector assembly of claim 14, further including a housing having one end for receiving the wire guide and another end configured to mate with a header.

20. The connector assembly of claim 19, wherein the lever includes a pair of gears that engage a corresponding pair of grooves formed on the housing as the lever is moved from the unlocked position to the locked position, thereby drawing the housing toward the header.

* * * * *